US010781996B2

(12) United States Patent
Martin et al.

(10) Patent No.: US 10,781,996 B2
(45) Date of Patent: Sep. 22, 2020

(54) RAY DESIGN AND MANUFACTURING METHODS

(71) Applicant: 3FORM, LLC, Salt Lake City, UT (US)

(72) Inventors: Guillaume Martin, Rochetoirin (FR); Ryan G. Smith, Seattle, WA (US)

(73) Assignee: 3FORM, LLC, Salt Lake City, UT (US)

( * ) Notice: Subject to any disclaimer, the term of this patent is extended or adjusted under 35 U.S.C. 154(b) by 0 days.

(21) Appl. No.: 16/098,701

(22) PCT Filed: May 8, 2017

(86) PCT No.: PCT/US2017/031591
§ 371 (c)(1),
(2) Date: Nov. 2, 2018

(87) PCT Pub. No.: WO2017/196747
PCT Pub. Date: Nov. 16, 2017

(65) Prior Publication Data

US 2019/0137070 A1 May 9, 2019

Related U.S. Application Data

(60) Provisional application No. 62/335,451, filed on May 12, 2016, provisional application No. 62/335,490, filed on May 12, 2016.

(51) Int. Cl.
*F21V 3/02* (2006.01)
*F21S 8/06* (2006.01)
(Continued)

(52) U.S. Cl.
CPC ..... *F21V 3/02* (2013.01); *F21S 8/061* (2013.01); *F21V 1/08* (2013.01); *F21V 1/22* (2013.01);
(Continued)

(58) Field of Classification Search
CPC .... F21S 8/061; F21V 1/08; F21V 1/22; F21V 3/02; F21V 3/062; F21V 1/26; F21V 1/00; F21Y 2103/10; F21Y 2115/10
See application file for complete search history.

(56) References Cited

U.S. PATENT DOCUMENTS 4,428,030 A * 1/1984 Baliozian ..... F21S 2/005 362/18
4,992,917 A * 2/1991 Earnshaw ..... A01G 7/045 359/850
(Continued)

FOREIGN PATENT DOCUMENTS

| | | |
|---|---|---|
| EP | 2508793 | 9/2013 |
| JP | 4517404 | 8/2010 |
| KR | 101270569 | 6/2013 |

OTHER PUBLICATIONS 10-1270569, Korean Patent, English Translation, Yeon, Jun. 7, 2013 (Year: 2013).*
(Continued)

*Primary Examiner* — Peggy A Neils
(74) *Attorney, Agent, or Firm* — Workman Nydegger

(57) ABSTRACT

A light shade can include a top surface formed by a plurality of adjacent, alternating peak and trough folds that define intervening facets, a bottom surface disposed opposite the top surface, and an edge surface transverse to and connecting the top surface and the bottom surface. The intervening facets can each be in the shape of a triangle with adjacent triangular facets sharing an edge. The shared edge can be one of a peak fold or a trough fold. One or more of the trough folds can have a plunge between the edge surface and an opposing side of the top surface. In an implementation, the light shade can be manufactured from a unitary polymeric sheet with the bottom surface being a mirror image of the top surface.

20 Claims, 16 Drawing Sheets

(51) Int. Cl.

| | |
|---|---|
| ***F21V 1/08*** | (2006.01) |
| ***F21V 1/22*** | (2006.01) |
| ***F21V 3/06*** | (2018.01) |
| ***F21Y 103/10*** | (2016.01) |
| ***F21Y 115/10*** | (2016.01) |

(52) U.S. Cl.
CPC ..... *F21V 3/062* (2018.02); *F21Y 2103/10* (2016.08); *F21Y 2115/10* (2016.08)

(56) References Cited

U.S. PATENT DOCUMENTS

| | | | | |
|---|---|---|---|---|
| 10,240,748 | B2 * | 3/2019 | Dietz | F21V 1/06 |
| 2003/0043587 | A1 | 3/2003 | Elster | |
| 2015/0109799 | A1 | 4/2015 | Wu | |
| 2017/0205059 | A1 * | 7/2017 | Yang | F21V 21/104 |
| 2018/0320846 | A1 * | 11/2018 | Sozzi | F21S 2/005 |

OTHER PUBLICATIONS

International Search Report and Written Opinion for International Application No. PCT/US2017/031591, dated Jul. 25, 2017.

* cited by examiner

RAY DESIGN AND MANUFACTURING METHODS

CROSS REFERENCE TO RELATED APPLICATIONS

This application is a 35 U.S.C. § 371 U.S. National Stage of PCT Application No. PCT/US17/031591, filed on May 8, 2017, which claims priority to U.S. Provisional Patent Application No. 62/335,490, filed May 12, 2016. PCT/US17/031591 also claims priority to U.S. Provisional Patent Application No. 62/335,451, filed May 12, 2016. The entire content of each of the aforementioned patent applications is incorporated herein by reference.

BACKGROUND

1. Technical Field

This disclosure relates to systems, methods, and apparatus for providing illumination.

2. Relevant Art

Recent trends in building design involve using one or more sets of decorative panels to add to the functional and/or aesthetic characteristics of a given structure or design space. In particular, the use of polymer-based panels is becoming increasingly popular in lighting applications. Such polymer-based materials may be manufactured to be more resilient and to have a similar transparent, translucent, or decorative appearance as cast or laminated glass, but with less cost. In addition, polymer-based materials tend to be more versatile or manipulatable in terms of manufacture and assembly as they can be relatively easily bent, molded, colored, textured, shaped, gauged, cut, and otherwise modified in a variety of different ways and can provide a larger variety of colors, images, interlayers, shapes, and impact resistance than can glass.

Certain polymer-based lighting applications involve polymeric sheet material, or panels, coupled together to form a lighting structure that has a specific, unique design or aesthetic. One drawback to such lighting systems is the unsightly gap or seam formed between two or more panels or lighting modules at the site of coupling, especially at edges of the lighting fixture. Connecting panels can also require adhesive or hardware that may produce shadows, dark spots, and/or other unsightly byproducts, which may detract from the aesthetic appeal of the lighting element. Panel coupling hardware can also add undesirable weight to a polymeric light fixture that is otherwise designed to be lightweight. Formation or assembly of complex lighting concepts, such as those having complex geometries, may require coupling a larger number of panels, further exacerbating the above problems. Once formed, such lighting fixtures may be difficult to modify without complete disassembly and re-assembly.

Accordingly, there are a number of limitations and/or disadvantages in polymer-based lighting fixtures that can be addressed.

BRIEF SUMMARY

Implementations of the present disclosure solve one or more of the foregoing or other problems in the art with light fixtures and assemblies, and methods of manufacturing or forming the same. For example, one or more implementations of the present disclosure include a light shade having a top surface formed by a plurality of adjacent, alternating peak and trough folds that define intervening facets, a bottom surface disposed opposite the top surface, and an edge surface transverse to and connecting the top surface and the bottom surface. The intervening facets, in some implementations, are each in the shape of a triangle with adjacent triangular facets sharing an edge that is, itself, one of a peak fold or a trough fold. In some implementations, one or more of the trough folds have a plunge between the edge surface and an opposing side of the top surface. The light shade can be manufactured from a unitary polymeric sheet, and in some implementations, the bottom surface is a mirror image of the top surface.

Additional features and advantages of exemplary implementations of the present disclosure will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the disclosure can be obtained, a more particular description of the disclosure briefly described above will be rendered by reference to specific implementations thereof, which implementations are illustrated in the appended drawings. Understanding that these drawings depict only typical implementations of the disclosure and are not, therefore, to be considered to be limiting of its scope, the disclosure will be described and explained with additional specificity and detail through the use of the accompanying drawings in which.

DETAILED DESCRIPTION

Figure 1:
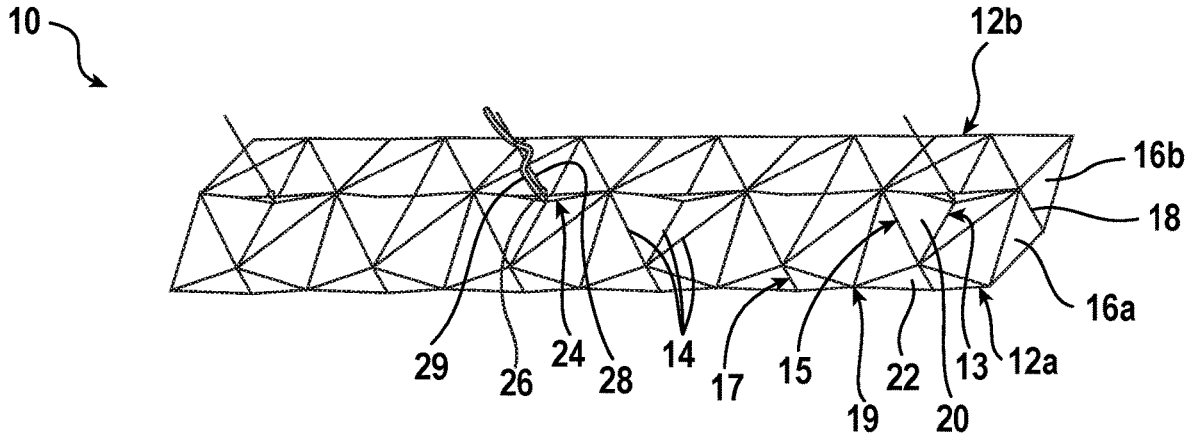
FIG. 1 illustrates a perspective view of a light fixture assembly and components.

Implementations of the present disclosure solve one or more of the foregoing or other problems in the art with light fixtures and assemblies, and methods of manufacturing or forming the same. For example, one or more implementations of the present disclosure include a light shade having a top surface formed by a plurality of adjacent, alternating peak and trough folds that define intervening facets, a bottom surface disposed opposite the top surface, and an edge surface transverse to and connecting the top surface and the bottom surface. The intervening facets, in some implementations, are each in the shape of a triangle with adjacent triangular facets sharing an edge that is, itself, one of a peak fold or a trough fold. In some implementations, one or more of the trough folds have a plunge between the edge surface and an opposing side of the top surface. The light shade can be manufactured from a unitary polymeric sheet, and in some implementations, the bottom surface is a mirror image of the top surface.

Before describing the present disclosure in further detail, it is to be understood that this disclosure is not limited to the description of the particularly exemplified systems, methods, and/or products that may vary from one implementation to the next. Thus, while certain implementations of the present disclosure will be described in detail, with reference to specific configurations, parameters, features (e.g., components, members, elements, parts, and/or portions), etc., the descriptions are illustrative and are not to be construed as limiting the scope of the claimed invention. In addition, the terminology used herein is for the purpose of describing the implementations, and is not necessarily intended to limit the scope of the claimed invention.

Unless defined otherwise, all technical and scientific terms used herein have the same meaning as commonly understood by one of ordinary skill in the art to which the present disclosure pertains.

Implementations of the present disclosure include light shades, light fixture assemblies, and methods of manufacturing the same. An illustrative light fixture assembly includes a spine, a lighting element associated with the spine, and a light shade associated with the spine and at least partially covering the lighting element. In such an implementation, the shade can include a top surface formed by a plurality of adjacent, alternating peak and trough folds that define intervening facets, a bottom surface disposed opposite the top surface, and an edge surface transverse to and connecting the top surface and the bottom surface.

In some implementations, the intervening facets formed by the alternating peak and trough folds are each in the shape of a triangle with adjacent triangular facets sharing an edge that is, itself, one of a peak fold or a trough fold. Additionally, or alternatively, the trough folds of the plurality of adjacent, alternating peak and trough folds alternate between a positive plunge trough fold and a negative plunge trough fold. In an implementation, the top surface, the bottom surface, and the edge surface can comprise a unitary polymeric sheet, the bottom surface being a mirror image of the top surface. The light fixture assembly can additionally include a second light shade associated with the spine positioned opposite the first light shade and being a mirror image thereof reflected over the spine.

Additionally, or alternatively, the light fixture assembly can further include one or more end pieces coupled to open ends of the first and/or second light shade. Mounting extensions can additionally be connected to the spine and coupled to a suspension member configured to suspend the light fixture assembly.

Methods of manufacturing light fixtures are additionally disclosed. For example, a method of manufacturing a light fixture can include the steps of assembling a light shade and coupling flanges of the light shade to a spine that is associated with a lighting element such that the light shade at least partially covers the lighting element. Assembling the foregoing light shade can include the steps of forming a plurality of fold lines on a unitary panel (e.g., a unitary polymeric panel), and folding the unitary panel along the plurality of fold lines. Folding the panel along the fold lines can create a top surface, a bottom surface disposed opposite the top surface, and an edge surface transverse to and connecting the top surface and the bottom surface. Additionally, folding the unitary panel along the fold lines creates a plurality of adjacent, alternating peaks and valleys that define intervening polygonal facets and one or more flanges disposed at opposing ends of the unitary panel.

In some implementations, a method for manufacturing a light fixture can additionally include one or more steps, including for example, assembling a second light shade by repeating the forming and folding steps performed for the first light shade. Additionally, the method can include coupling the flanges of the second light shade to an opposite side of the spine as the first light shade, and affixing mounting extensions to the spine. In some implementations, the mounting extensions are additionally coupled to a suspension member configured to suspend the light fixture assembly.

As used herein, the terms "polymeric panel," "polymer-based material," and the like refer to a panel, film, sheet, or other elements comprising a substrate of one or more layers formed from one or more thermoplastic polymers (or alloys thereof). Specifically, such materials can include, but are not limited to, polyethylene terephthalate (PET), polyethylene terephthalate with glycol-modification (PETG), acrylonitrile butadiene-styrene (ABS), polyvinyl chloride (PVC), polyvinyl butyral (PVB), ethylene vinyl acetate (EVA), polycarbonate (PC), styrene, polymethyl methacrylate (PMMA), polyolefins (low and high density polyethylene, polypropylene), thermoplastic polyurethane (TPU), cellulose-based polymers (cellulose acetate, cellulose butyrate or cellulose propionate), acrylics, or the like. Polymeric panels and/or materials can also be opaque or non-opaque (translucent or transparent) in various implementations.

One or more implementations of the present disclosure include light fixture assemblies having a central mounting spine and opposing light shade assemblies. The opposing light shade assemblies are attached to the spine and extend away from the spine in opposite directions. In one implementation, a light shade assembly includes a sheet having a plurality of folds that, when folded, create at least a top surface, a bottom surface, and an edge surface of the light shade assembly. The top surface, for example, includes a plurality of folds that create alternating convex and concave surfaces running lengthwise along the top surface. In some implementations, a convex surface portion of the top surface includes a fold partitioning two adjacent faces with the fold defining a shared edge of the two adjacent faces and being a "peak" fold (e.g., positioned at a higher elevation than at least an opposing or adjacent edge). A concave surface portion of the top surface includes a fold partitioning two adjacent faces with the fold defining a shared edge of the two adjacent faces and being a "trough" fold (e.g., positioned at a lower elevation than at least one opposing or adjacent edge).

In some implementations, a face or facet of the top surface is simultaneously a facet of a convex surface and a concave surface. For example, the facet can include at least two edges, a first edge defining a peak fold and a second edge defining a trough fold. The facet spans the distance between the trough fold and the peak fold, and depending on the perspective, the facet can be part of a convex face or a concave face. If the facet is perceived with the peak fold and another facet sharing an edge defining the peak fold, it can be perceived as part of a convex face. If, however, the facet is perceived with the trough fold and another facet sharing an edge defining the trough fold, that facet can be perceived as part of a concave face. Regardless of whether the facet is perceived as part of a convex or concave face, the top surface can be formed by a series of adjacent, alternating peak and trough folds with intervening faces or facets.

The edge surface can be formed from a different plurality of alternating convex and concave surfaces similarly having a series of alternating peak and trough folds. One or more folds defining peaks (or troughs) of the edge surface lie in a plane that is transverse to the plane containing at least one fold defining the peaks (or troughs) of the top surface. In other words, and in some implementations, a fold that defines a peak (or trough) of the edge surface lies parallel to a vertical plane and a fold that defines a peak (or trough) of the top surface lies parallel to a plane that is transverse to the same foregoing vertical plane. In one or more implementations, the top surface and edge surface of the light shade assembly are orthogonal.

In one implementation, the edge surface comprises triangular facets. The triangular facets can be, in an embodiment, isosceles triangles. The base of a first isosceles triangle can be joined to the base of an adjacent isosceles triangle, the joined edge thereof being a trough fold. In an alternative embodiment, the fold comprises a peak fold.

In some implementations, the light shade assembly additionally includes a bottom surface opposite the top surface. The bottom surface is, in some implementations, a reflection of the top surface about an axis parallel to the length of the edge surface. The bottom surface includes a plurality of folds defining alternating peaks and troughs in a similar or substantially the same manner as described above with respect to the top surface. In some implementations, the combined orientation of the top surface, the edge surface, and the bottom surface is akin to looping one side of a polymeric panel back around to the opposite side, such that the opposing sides are brought adjacent to or into proximity with one another with an edge surface positioned transversely therebetween.

In some implementations, and as described below with respect to the Figures, the folds along the top surface, for example, create an angular surface appearance. Particularly, the folds separate portions of the surface into facets such that each facet is in the shape of a triangle. Two adjacent triangular facets share an edge, the edge being a fold therebetween. Where the fold is a peak, the fold line is not plunged toward the front or the back of the light shade assembly but, rather, has a nonnegative, non-positive slope or at most a slightly positive or slightly negative slope (e.g., $-0.1<x<0.1$, where x=the slope of the fold line).

On the other hand, in some implementations fold lines representing troughs have a plunge (e.g., vertical plunge with respect to a horizontal line or plane representing the endpoint of the trough fold proximate the surface edge). In some implementations, the plunge of the trough folds reverses between peak folds. For example, a first trough fold can be said to have "negative plunge" (or slope) running away from the edge surface. The adjacent trough fold (falling on the opposite side of an intervening peak fold) has a "positive plunge" (or slope) running away from the edge surface. A negative plunge indicates the endpoint of the trough fold proximate the edge surface is higher than the opposing endpoint proximate the spine attachment end of the top surface, whereas a positive plunge indicates the endpoint of the trough fold proximate the edge surface is lower than the opposing endpoint proximate the spine attachment end of the top surface.

The plunge can be measured as the angle of ascension between the edge surface and the opposing spine attachment end of the top surface—positive angles being measured clockwise from the horizontal and negative angles being measured counterclockwise from horizontal. The severity of the plunge (or slope) can depend on many factors. In some implementations, the plunge of the trough folds is proportional to the difference in height between a tallest point on the edge surface and the lowest point on the spine-facing side of the top surface and the width of the top surface.

In the top surface configuration described above, a fold arrangement of peak-trough-peak with the trough fold having a positive plunge (or slope) running toward the edge surface yields a visual unit having four facets. Each of the folds of the visual unit span from the spine edge to the edge surface with each of the edge surface ends thereof converging at a single shared vertex. Duplicating and concatenating the foregoing visual unit creates the same repeating pattern described above with alternating peaks and troughs, the alternating trough folds having opposite plunge (or slope).

In some implementations, the disclosed light shade assemblies include repeating geometric patterns and symmetries, such as those described above.

Upon conforming, bending, and/or folding a sheet into the configuration described above, the light shade assembly can include open ends and/or an open top or nearly open top (as an attachment surface may extend at least partially within the region that would otherwise define the open top). In some implementations, the ends of the light shade assembly can remain open. In some implementations, however, the light shade assembly includes cap elements sized and shaped to enclose the ends of the light shade assembly. In an implementation, the cap element is triangular shaped.

In some implementations, the adjacent, opposing sides of the light shade assembly (e.g., the top and bottom surfaces) can be attached to the spine at a (linear and/or planar) attachment interface. That is, in some implementations, at least a portion of the top surface and/or the bottom surface includes additional fold(s) that project an attachment plane that is transverse to the top and/or bottom surfaces and configured to attach to the spine.

In an implementation, two opposing light shade assemblies are associated with and/or connected to a spine. In at least one implementation, only one shade attaches to and extends from the spine. The spine is, in some implementations, a light source and/or associated with a light source. In one implementation, the light shade assembly includes an attachment plane that is connected to hanging elements and/or a cover that includes or is associated with a light source.

The light shade assemblies of the present disclosure provide many advantages. For example, the light shade assemblies include angular surfaces that deflect and diffuse light, which can, in some implementations, temper or balance a light source. Additionally, or alternatively, the disclosed light shades can provide even and distributed light without—or at least with substantially less—visible joints and/or discontinuities on or within the shade. Implementations of the present disclosure also provide methods for constructing and/or forming a light shade assembly (or a substantial portion thereof—e.g., top, bottom, and edge surfaces thereof) from a single sheet. This provides the same or similar benefits described above, including continuity in surface texture, density, and/or thickness, which can help to temper or balance a light source or may additionally, or alternatively, provide an even and distributed light along the shade.

In addition to the foregoing advantages, manufacturing a light shade assembly from a single sheet is advantageous as it can decrease the cost of manufacturing. For example, instead of manufacturing individual facets or other smaller portions of the light shade assembly followed by coupling the facets/smaller portions, a single sheet can be bent, molded, or otherwise conformed to the desired configuration. This eliminates the need for the additional cost and expense of fasteners or adhesives and the associated work of coupling facets/smaller portions together. In some implementations, the light shade assembly is made of a polymer-based material, which can additionally reduce the cost of manufacturing while nonetheless providing the desired look and feel of glass or other material.

Turning now to the figures, FIG. 1 illustrates a perspective view of light fixture assembly 10 in accordance with an implementation of the present disclosure. By way of example, light fixture assembly 10 illustrates a first shade 12*a* and a second shade 12*b* attached to opposing sides of a mounting element (or spine) 18. A first end piece 16*a* is illustrated as attached to a first end of first shade 12*a* and a second end piece 16*b* is illustrated as attached to a first end of second shade 12*b* and aligned with first end piece 16*a*. Alternatively, end pieces 16*a* and 16*b* can be a single unitary end piece 16. An opposing second end of the light fixture assembly 10 (or each shade 12 thereof) can also have an end piece 16 attached thereto. Shade 12 with opposing end pieces 16 can form a shade assembly configured for attachment or connection to mounting element (or spine) 18.

Figure 2:
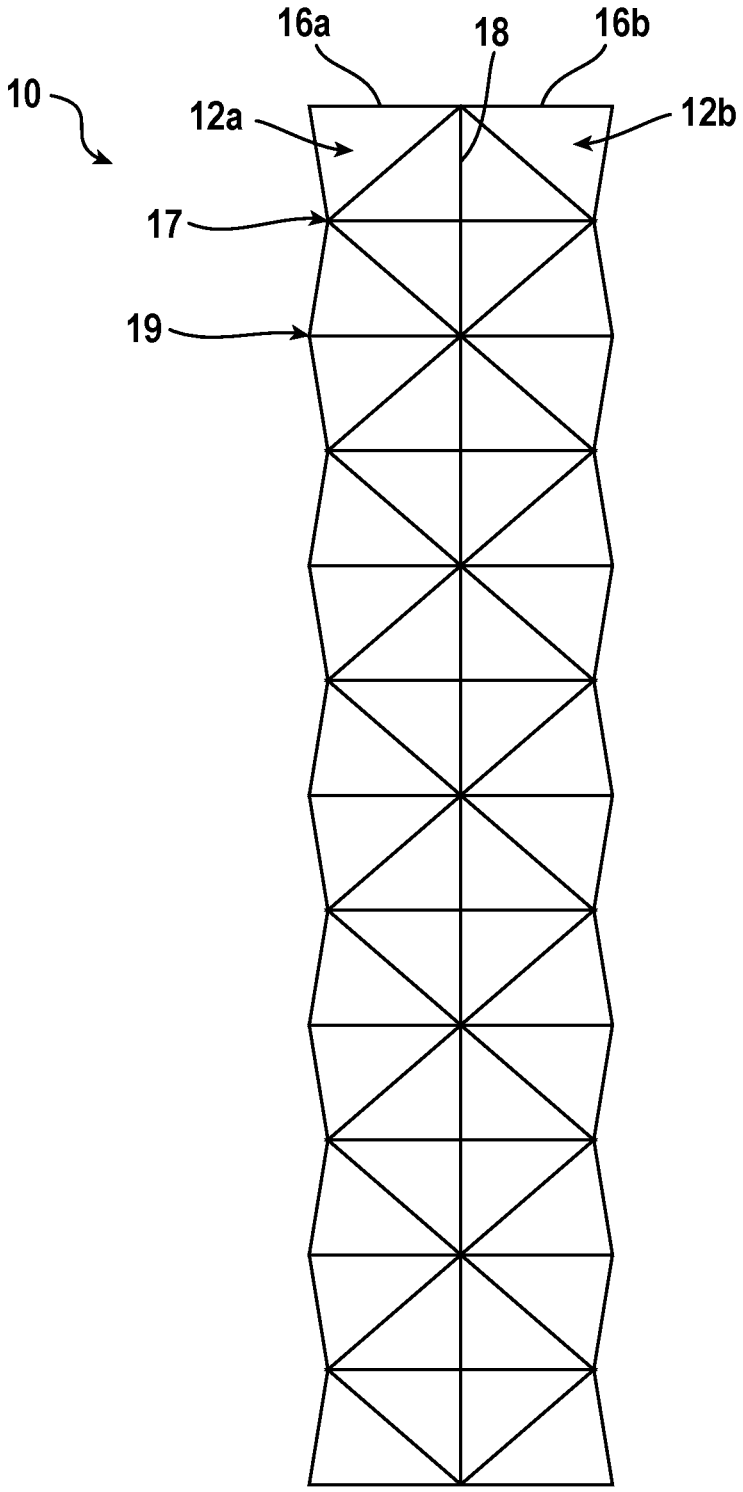
FIG. 2 illustrates a bottom plan view of a light fixture assembly illustrated in FIG. 1.

Shade 12*a* can comprise a single and/or unitary sheet or panel that is folded along a plurality of fold lines 14 so as to form a plurality of (raised) peaks 15, 19 and a plurality of (recessed) valleys 13, 17. In the depicted implementation, for instance, shade 12*a* is made from a single, unitary panel. Fold lines 14 form a plurality of triangle-shaped facets 20 that alternate in orientation to form larger, alternating pyramidal faces. Corresponding triangle-shaped lower facets are similarly formed on the bottom side of shade 12*a* (as shown in FIG. 2). Fold lines 14 also form a plurality of triangle-shaped side facets 22 disposed on an edge surface between upper facets 20 and the corresponding lower facets. Side facets 22 also alternate in orientation to form a series of rhombus or diamond-shaped concave valleys 17 with pointed peaks 19 disposed therebetween. In at least one implementation, facets 20 and 22 can be or have a substantially planar, straight, and/or uncurved or unbent configuration.

Shade 12*a* can be formed from a plurality of substantially planar, triangle-shaped facets that alternate between opposing angled orientations (relative to one another) so as to form a partially geospheric-type pattern across the top and bottom surfaces thereof. Alternating side facets 22 can provide a connection component and/or turning component for the top and bottom surfaces. Accordingly, shade 12*a* can be symmetrical about the line or plane extending lengthwise along the side surface.

In the depicted implementation, mounting element (or spine) 18 includes a planar, structural component having a shape or perimeter that corresponds to the shape of shade 12*a* (or the upper and/or lower surface portion of shade 12*a* connected and/or adjacent thereto). Thus, the perimeter of spine 18 can also include alternating peaks and valleys. Shade 12*a* is illustrated in FIG. 1 as being attached to a first side of spine 18 with shade 12*b* being attached to a second side of spine 18 opposite the first side. Accordingly, as depicted in FIG. 1, shades 12*a* and 12*b* extend in opposite directions from spine 18.

Spine 18 can be formed of a substantially or at least partially rigid material, such as powder-coated aluminum, or other metals or metal alloys. It will be appreciated, however, that spine 18 can be formed of any suitable material.

Similarly, shades 12 can be made of any suitable material. In some implementations, the shades are polymeric. In other embodiments, the shades are made of glass, perforated metal, or other translucent material.

As illustrated in FIG. 1, the upper perimeter edge of spine 18 can include one or more mounting extensions 24 that extend beyond the shape of shades 12*a*, 12*b* (or the upper and/or lower surface portions of shades 12*a*, 12*b* connected and/or adjacent to spine 18). A mounting element (or fastener) 26 can be connected to extensions 24 (or other suitable portion of spine 18), such that light fixture assembly 10 can be suspended by means of a cable or other suspension member 28.

Light fixture assembly 10 can also have one or more lighting element(s) (not shown). A power cord 29 can provide electricity to illuminate the lighting element(s) and, thereby illuminate light fixture assembly 10. The lighting element(s) can be disposed within shade(s) 12*a*, 12*b* in certain implementations. For instance, the lighting element(s) can be connected and/or attached to mounting element (or spine) 18 (e.g., on one or more (both) sides thereof).

Figure 3:
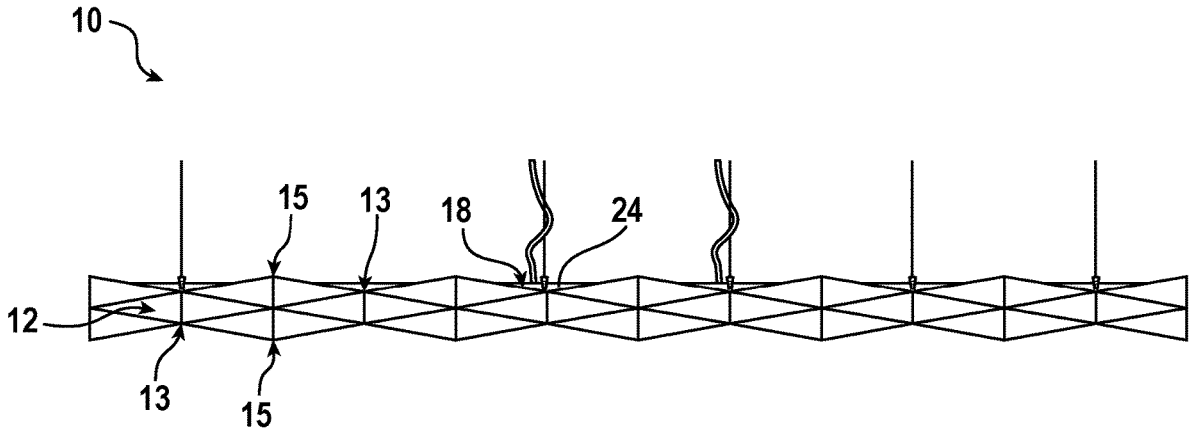
FIG. 3 illustrates a side elevation view of a light fixture assembly of FIG. 1.
Figure 4:
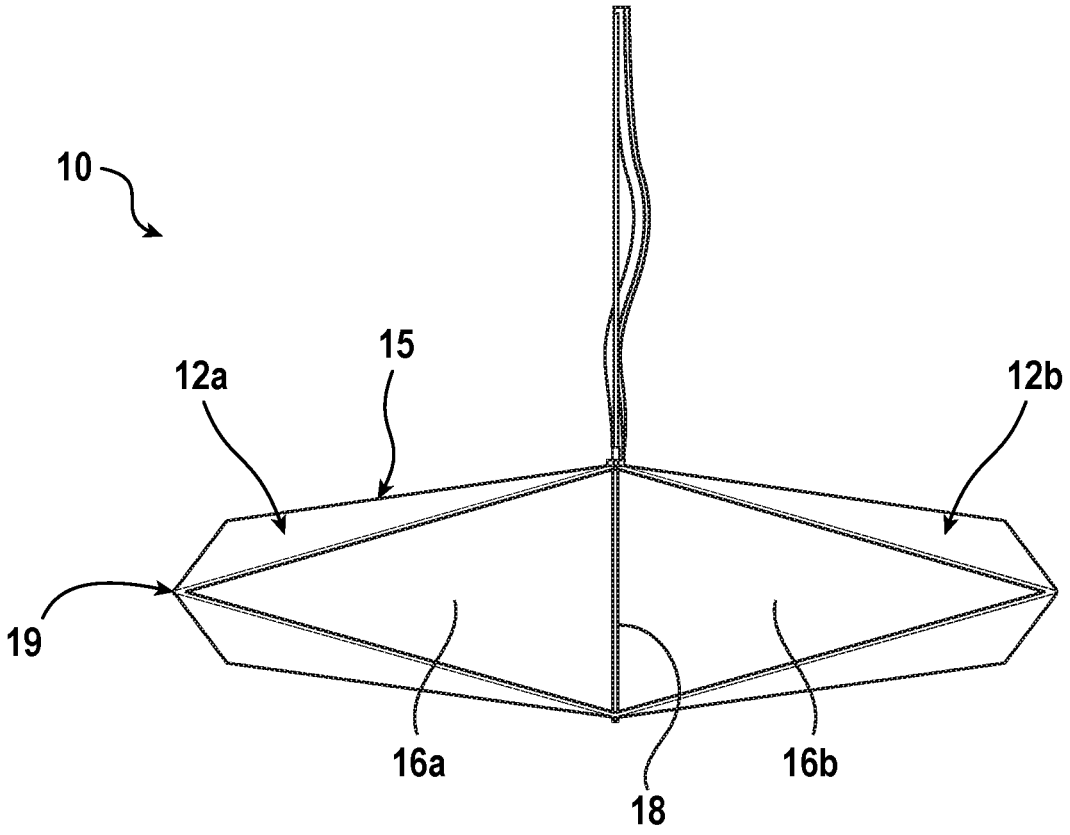
FIG. 4 illustrates an end elevation view of a light fixture assembly of FIG. 1.

FIGS. 2-4 depict additional views of light fixture assembly 10, illustrating peaks 15, 19 and valleys 13, 17 formed therein. As illustrated in FIGS. 2-4, a seam is formed between shades 12*a*, 12*b* and spine 18 and/or between shades 12*a*, 12*b* and end piece(s) 16*a*, 16*b*. In an implementation, however, light fixture assembly 10 and/or shades 12*a*, 12*b* thereof can be further configured to hide and/or reduce visibility of such seams or components (from one or more vantage points), such as with an overhang, flap or tab, a notch or cut, and/or other structural feature adapted to accomplish the same.

FIG. 3 illustrates a side elevation view of the light fixture assembly of FIG. 1. As depicted in FIG. 3, at least a portion of spine 18 can be visibly exposed at the upper surface of a light fixture assembly 10. For example, mounting extension 24 is visibly exposed at the upper surface of the light fixture assembly 10. In other implementations, spine 18 may not include mounting extension 24 or may not visibly expose the mounting extension on the top surface. In an alternative implementation, light fixture assembly 10 can be mounted on a lighting stand attached to end pieces 16*a*, 16*b*, so as to form a table lamp or a floor, wall, or pillar lamp, which may, in some implementations be mounted or suspended by a pole or other support structure. In such implementations, a mounting extension 24 may not be required and can be omitted.

Referring now to FIG. 4, illustrated is an end elevation view of the light fixture assembly of FIG. 1. FIG. 4 illustrates, for example, how the shades 12*a* and 12*b* include an upper surface portion attached to and extending away from the spine 18 that bends/folds to form an edge surface, and bends/folds back toward the spine 18 to form a lower surface portion that terminates at and attaches to spine 18. Also illustrated by FIG. 4, the upper and lower surface portions are mirrored about a line or plane passing through the edge surface. Further, shades 12*a* and 12*b* are mirror images of each other about the spine 18.

In an alternative implementation, the upper and lower surface portions of shades 12*a* and 12*b* can connect to spine 18 at a different angle than depicted in FIG. 4. For example, the angle may be larger (e.g., having a greater distance between the upper and lower surface portions where connected at the spine) or smaller (e.g., having a shorter distance between the upper and lower surface portions where connected at the spine), assuming a fixed arm length as measured along peak fold lengths. In one implementation, the angle defined by a top peak fold and a complementary bottom peak fold is greater than 30°, greater than 45°, greater than 60°, greater than 75°, greater than 90°, less than 105°, less than 120°, less than 135°, less than 150°, or any range selected therebetween. In one implementation, the aforementioned angle is between 30° and 60°. In another implementation, the aforementioned angle is generally a right angle.

It should be appreciated that in some implementations, the top surface and/or the bottom surface could additionally form any number of angles with respect to a horizontal plane that is transverse (e.g., orthogonal) to the spine. Stated another way, the top surfaces and/or the bottom surface could be pitched at different angles with respect to the spine and/or edge surface than what is depicted in FIG. 4. For example, the angle or pitch of the top/bottom surface with respect to a horizontal plane orthogonal to the spine is less than 90°, less than or equal to 60°, less than or equal to 45°, less than or equal to 30°, less than or equal to 15°, or any range selected therebetween.

Additionally or alternatively, in some implementations, the top and bottom surfaces are symmetric about a horizontal plane cutting through the spine. Alternatively, the top and bottom surfaces could be asymmetric. For example, the top surface can include a first set of angles between each peak and/or valley, whereas the bottom surface can include a second set of angles between each peak and/or valley such that at least one angle of the second set of angles is different than the angles in the first set of angles. Illustratively, the top surface could include a set of harsh angles (e.g., acute angles defining peaks and/or valleys) whereas the bottom surface could include a set of softer angles (e.g., obtuse angles defining the peaks and/or valleys).

In some implementations, a light fixture assembly can be the same as the light fixture assembly 10 illustrated in FIGS. 1-4, or it can be different. For example, a light fixture assembly can differ in length, position, and/or number of mounting extensions 24 associated therewith. In alternative implementations, light fixture assemblies can have different shapes. For instance, facets can have a variety of shapes and/or sizes, including but not limited to rectangular, square, trapezoidal, rhombal, pentagonal, hexagonal, or any other suitable geometric or other shape.

Figure 5:
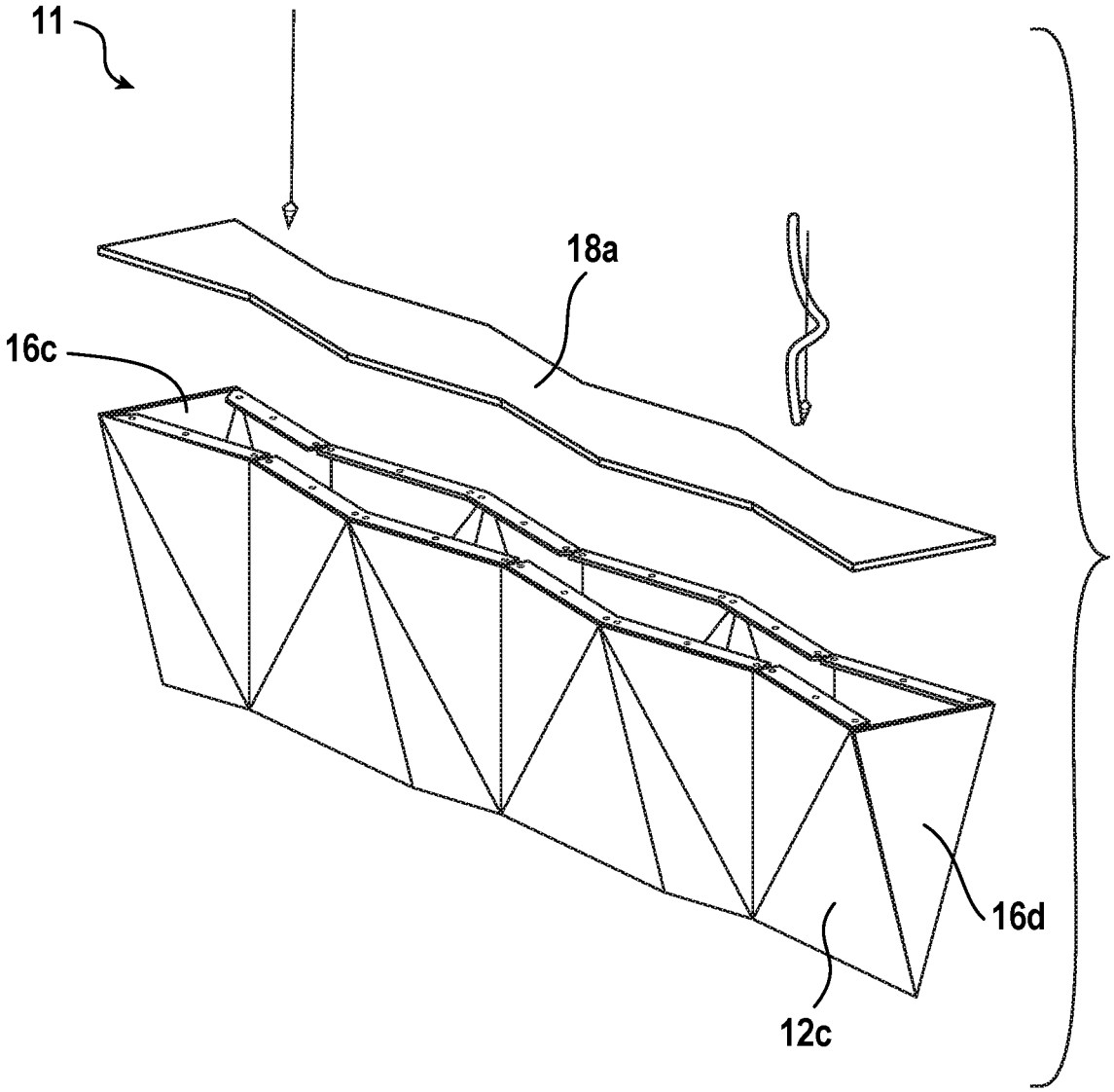
FIG. 5 illustrates an exploded perspective view of a light fixture assembly.

FIG. 5 illustrates an alternative light fixture assembly 11 comprising a mounting element 18*a* and a single shade 12*c* attached or connected thereto and/or extending therefrom. Mounting element 18*a* can have any suitable color and may be opaque or non-opaque. Opposing end pieces 16*c* and 16*d* can also be attached to shade 12*c* as described previously (forming a shade assembly).

In FIG. 5, shade 12*c* is mounted at what is illustrated as a top portion of the shade. However, it should be appreciated that the orientation or designation of that surface as the "top" is made for ease of reference. Shade 12*c* could, in some implementations be connected to a spine such that the "top" surface of shade 12*c* in FIG. 5 would be a side surface. Thus, what is depicted as the sides of shade 12*c* could, in some implementations, be analogous to the top and/or bottom of shades 12*a* and 12*b* of FIGS. 1-4. Accordingly, in one or more implementations, the foregoing description with respect to shades 12*a* and 12*b* are operable with or at least analogous to shade 12*c* of FIG. 5 such that the description for the top surface, bottom surface, and edge surface of shades 12*a*, 12*b* apply to the side surfaces and edge surface of shade 12*c*.

For example, similar to the description above with respect to shade 12*a*, shade 12*c* can comprise a single and/or unitary sheet or panel that is folded along a plurality of fold lines so as to form a plurality of (raised) peaks and a plurality of (recessed) valleys. Shade 12*c* can be made from a single, unitary panel, similar to the description provided for shade 12*a*. Fold lines can form a plurality of triangle-shaped facets that alternate in orientation to form larger, alternating pyramidal faces along a side face. Corresponding triangle-shaped facets can similarly be formed on an opposing side of shade 12*c* (not shown). Fold lines can also form a plurality of triangle-shaped bottom facets disposed on an edge surface between the sides. The bottom facets can alternate in orientation to form a series of rhombus or diamond-shaped concave valleys with pointed peaks disposed therebetween. The foregoing is illustrative that the surface designations used herein (e.g., top, bottom, side, etc.) are used simply for convenience, and descriptions incorporating such designations should be understood to apply generally and are not limited to the recited orientation.

As depicted in FIGS. 6A-6D, shade 12*c* can be configured similarly or identically to other shades described herein. For example, peaks 15*a* and 15*b* can be formed by convex fold lines 14*a* and 14*b*, respectively. Similarly, valleys 13*a* and 13*b* can be formed by concave fold lines 14*c* and 14*d*, respectively. An alternating pattern of fold lines 14 forms each surface of shade 12*c*. The angle, orientation, or relationship between such surfaces provides or forms a general or overall tubular or trough-like structure with a hollow interior cavity 30. As described above, lighting elements can be disposed in and/or illuminate within the hollow interior cavity 30.

Figure 6A:
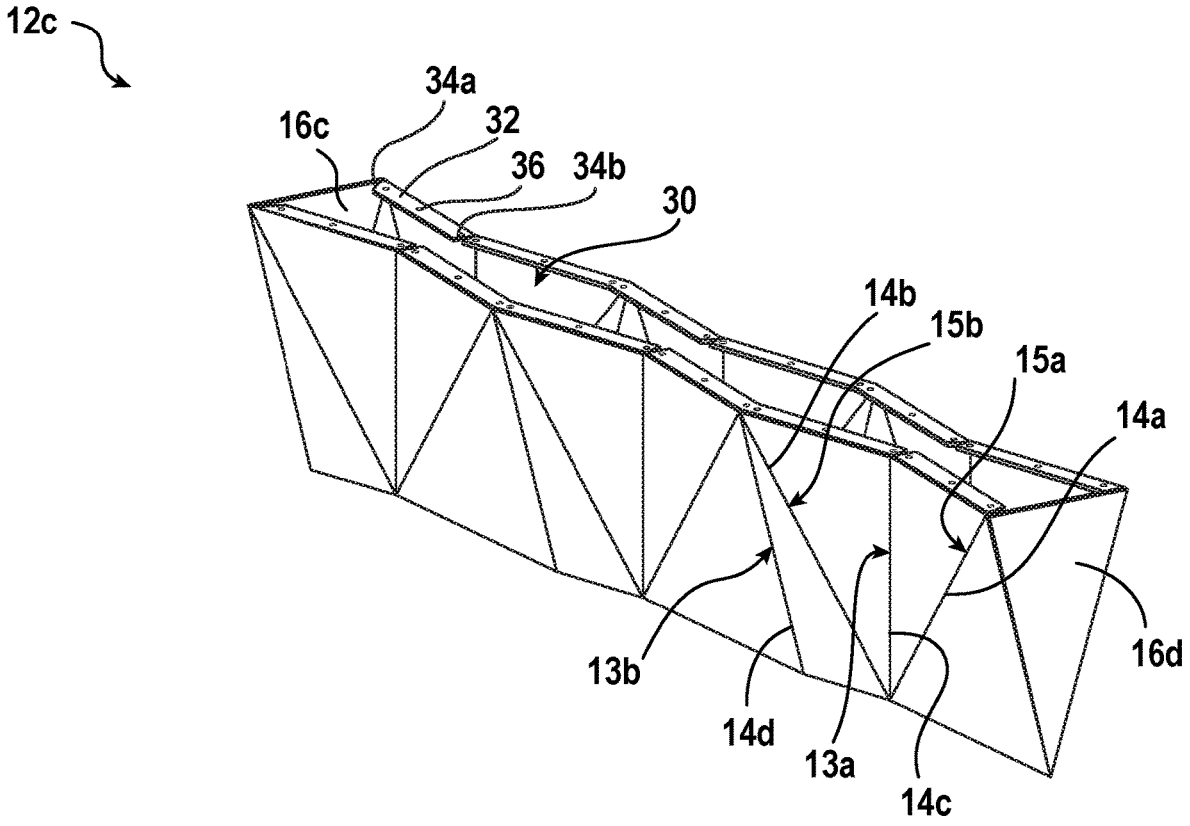
FIG. 6A illustrates a perspective view of an implementation for a folded panel useful in forming a light fixture assembly.

As depicted in FIG. 6A, each triangular facet can be connected to one or more adjacent facets, with a fold line 14 disposed therebetween. Fold lines 14*a* and 14*b* can form peaks 15*a* and 15*b*, respectively, allowing the adjacent facets to fold and/or extend towards cavity 30. Fold lines 14*c* and 14*d*, on the other hand can form valleys 13*a* and 13*b*, respectively, allowing the adjacent facets to fold and/or extend away from cavity 30.

Figure 6B:
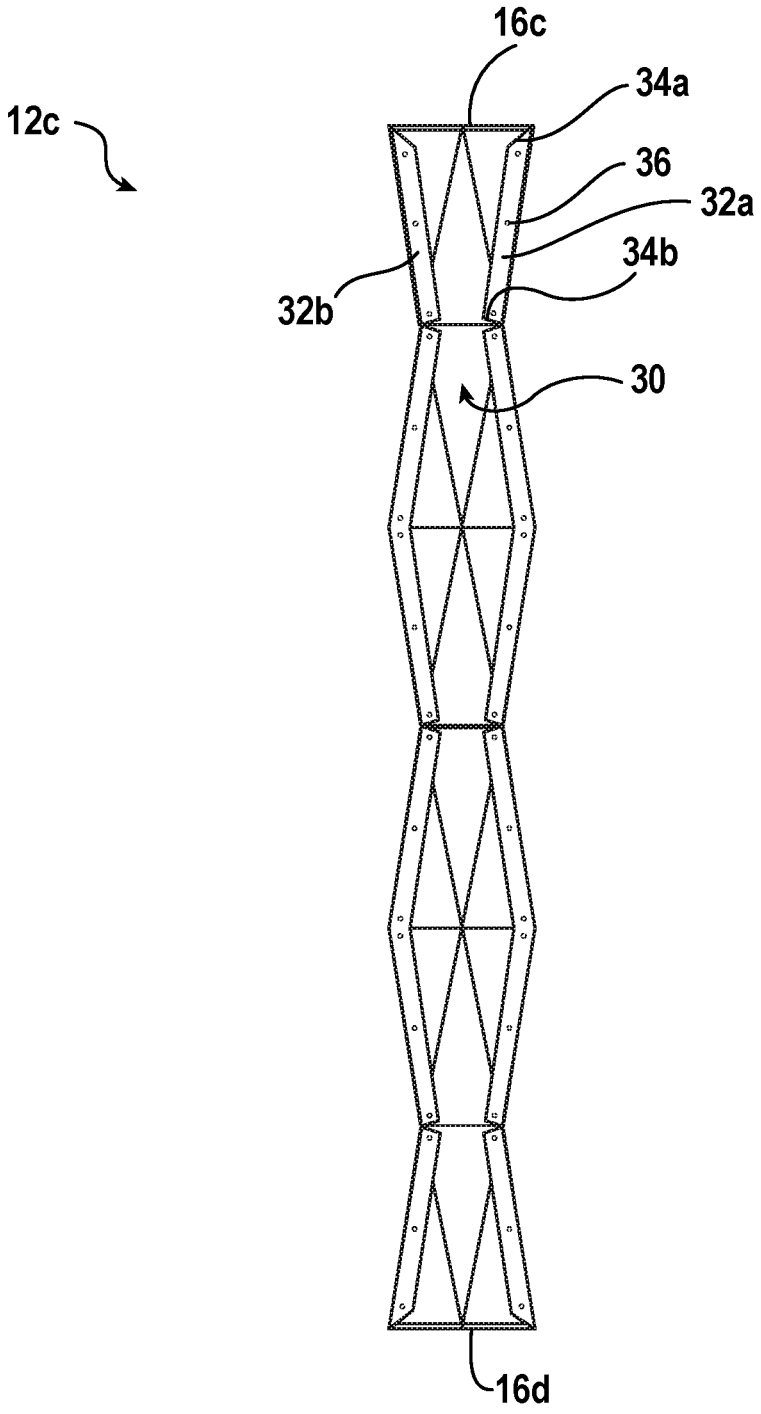
FIG. 6B illustrates a top plan view of the folded panel of FIG. 6A.

As further depicted in FIGS. 6A and 6B, the upper perimeter edges of shade 12*c* can also have one or more flanges 32 extending therefrom (e.g., at an angle, such as less than or equal to 90° from a top edge of the top and/or bottom surface portions). Flanges 32 can be formed of the same material as the surface panel material and can optionally be thermoformed, extruded, or die cast as a unitary piece of material. Flanges 32 can also have one or more opposing recessed or notched edges, such as edges 34*a* and 34*b*, and can additionally include one or more optional attachment openings 36. Recessed or notched edges 34*a*, 34*b* can allow flanges 32 adjacent to each other to be disposed in the same plane without contacting or interfering one with another due to the bending/curvature of the side surface. Attachment openings 36 can be adapted for attaching shade 12*c* to mounting element 18 by means of one or more fasteners (not shown), such as screws, bolts, nuts, anchors, rivets, etc. An adhesive can also or alternatively be used to attach shade 12*c* to mounting element 18.

Figure 6C:
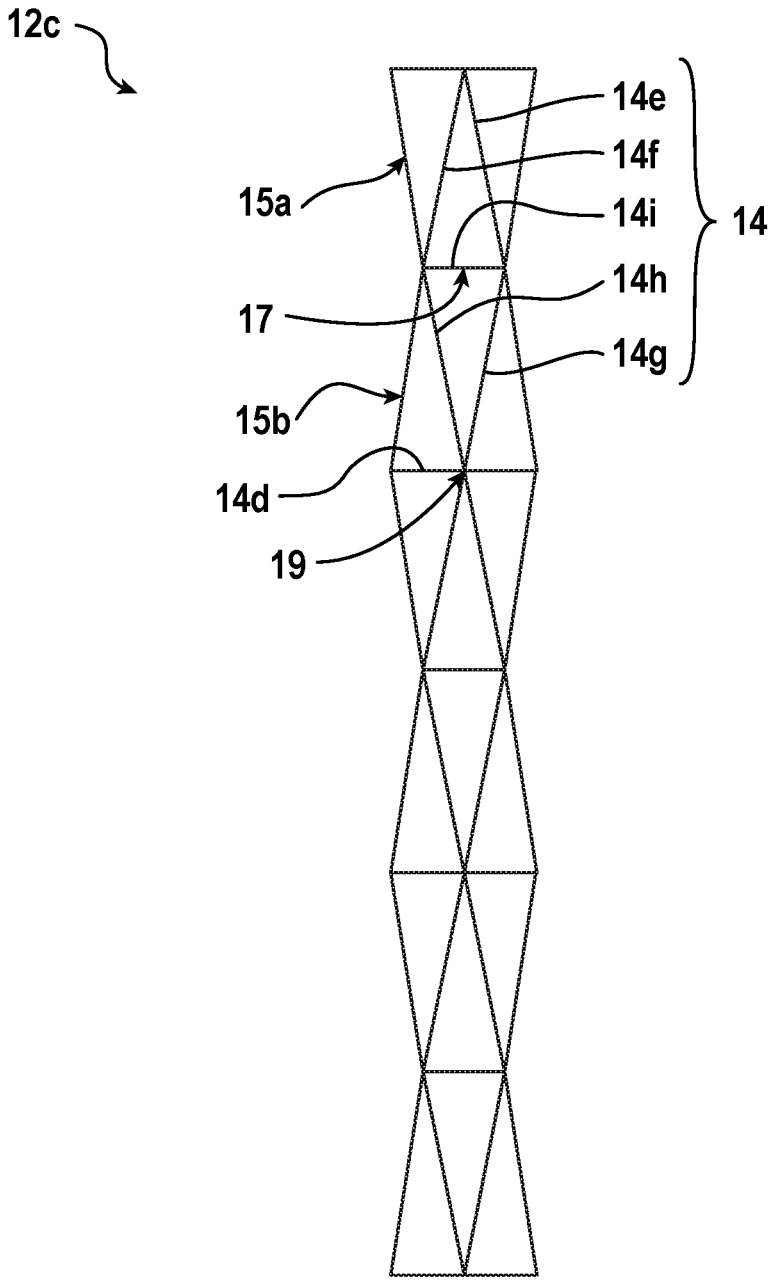
FIG. 6C illustrates a bottom plan view of the folded panel of FIG. 6A.
Figure 6D:
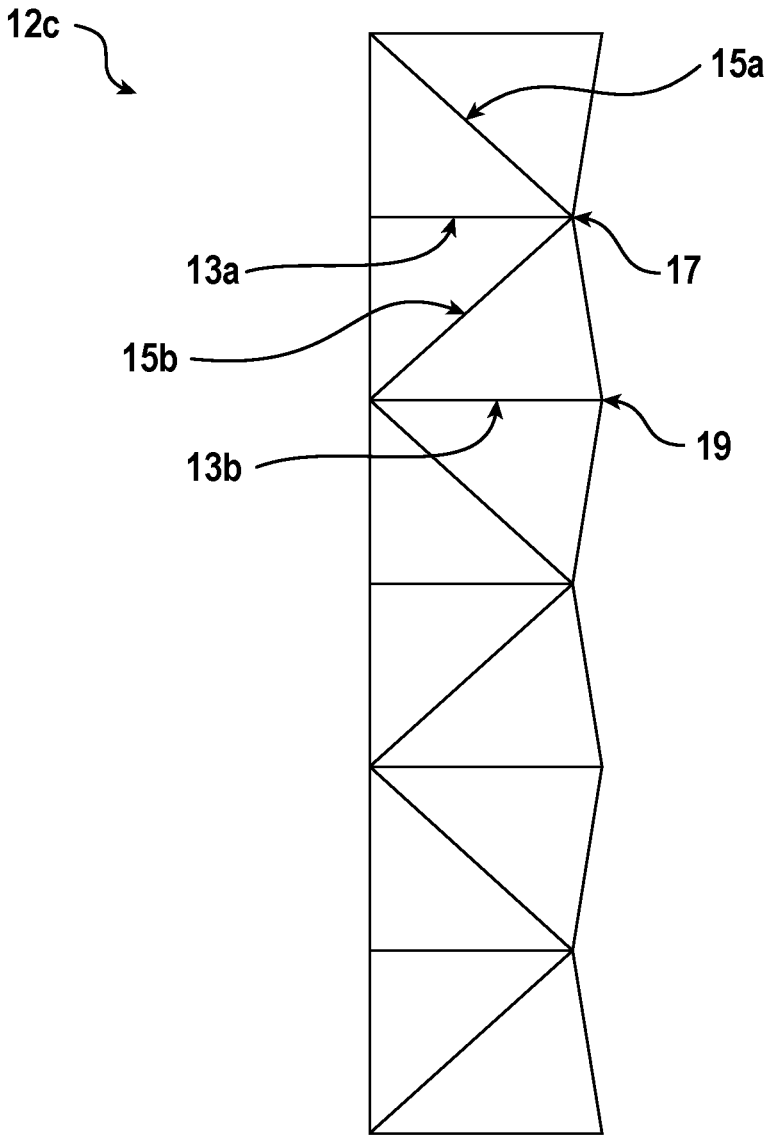
FIG. 6D illustrates a side elevation plan view of the folded panel of FIG. 6A.

FIG. 6C depicts a bottom view of shade 12*c* that illustrates fold lines 14*e*-14*i*, which form valleys 17 and peaks 19. FIG. 6D illustrates some of the above features from a side elevation view of shade 12*c*.

Figure 7:
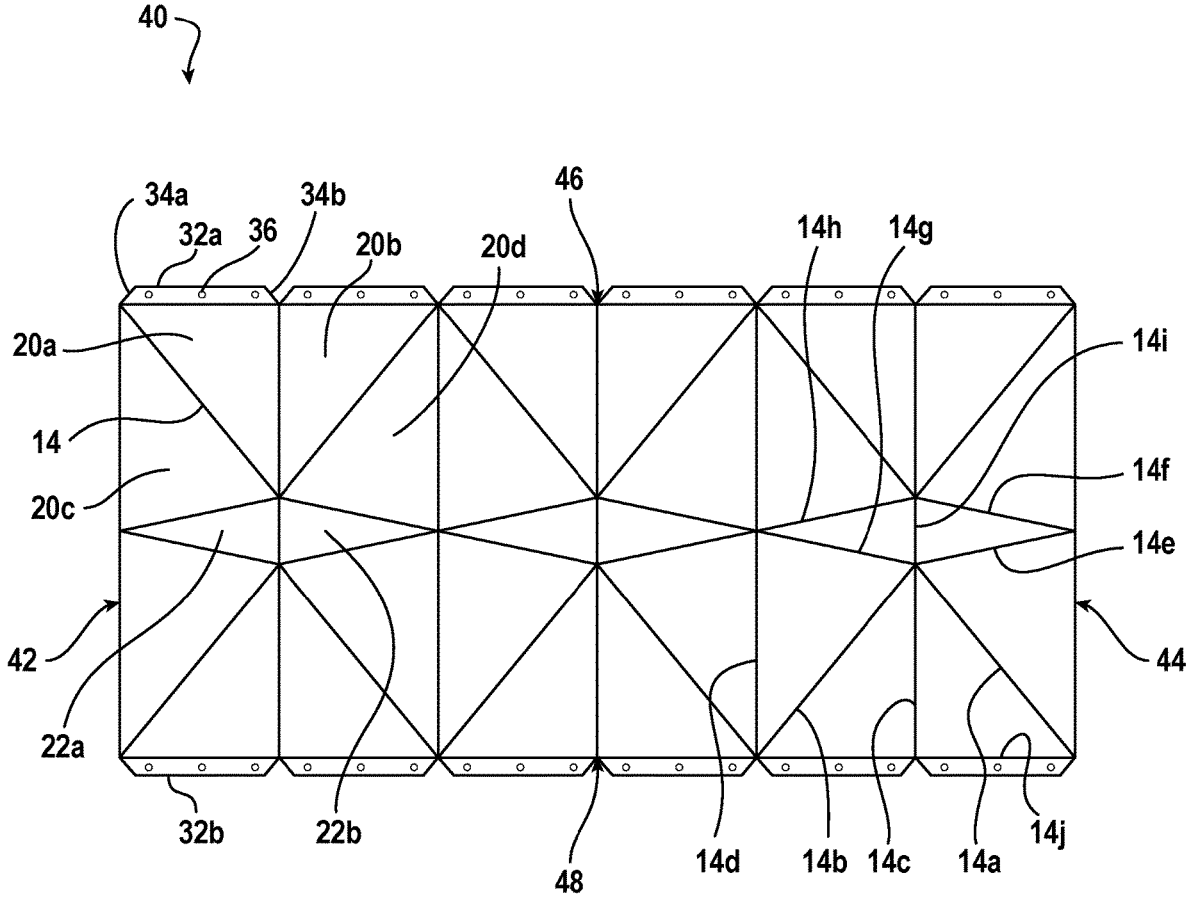
FIG. 7 illustrates a top plan view of a panel useful in forming a light fixture assembly in accordance with an implementation of the present disclosure.

FIG. 7 illustrates a top plan view of a panel (or polymeric template) 40 useful in forming a shade, such as shade 12*c*. Panel 40 extends longitudinally from a first end 42 to an opposing second end 44 and laterally from a first side 46 to a second side 48. A first flange 32*a* extends from each of the triangular facets 20*a* and 20*b* that have a base thereof aligned with the first or second side 46, 48. A fold line 14*j* is disposed between the flanges 32*a*, 32*b* and the respective base edge of the facets. Facets 20*a* and 20*b* are depicted as right triangles in FIG. 7 with a fold line 14*c* disposed therebetween. Facets 20*c* and 20*d*, which are not right triangles, in the depicted implementation, are joined to the hypotenuse edge of facets 20*a* and 20*b*, respectively, with fold lines 14*a* and 14*b* respectively disposed therebetween. Facets 22*a* and 22*b* extend from facets 20*c* and 20*d*, respectively, with fold lines 14*f* and 14*h*, respectively, disposed therebetween. Opposing fold lines 14*e* and 14*g* connect to facets 22*a* and 22*b* to opposing facets 20. A fold line 14*i* is also disposed between facets 22*a* and 22*b*.

Fold lines 14 can be formed in panel 40 by any suitable means, as known in the art. For example, the polymeric material of panel 40 can be processed (e.g., scored, perforated, indented, removed, or otherwise altered (to enhance the foldability of panel 40) along or to form lines 14. Specifically, one or more surfaces of panel 40 can be processed to create folding lines 14. In at least one implementation, a surface of panel 40 can be scored to enhance foldability of panel 40 towards or away from the scored surface. By alternating the scoring surface for alternating folding lines 14, panel 40 or facets 20, 22 thereof can be inclined to fold (in alternating directions), so as to form shade 12.

Figure 8:
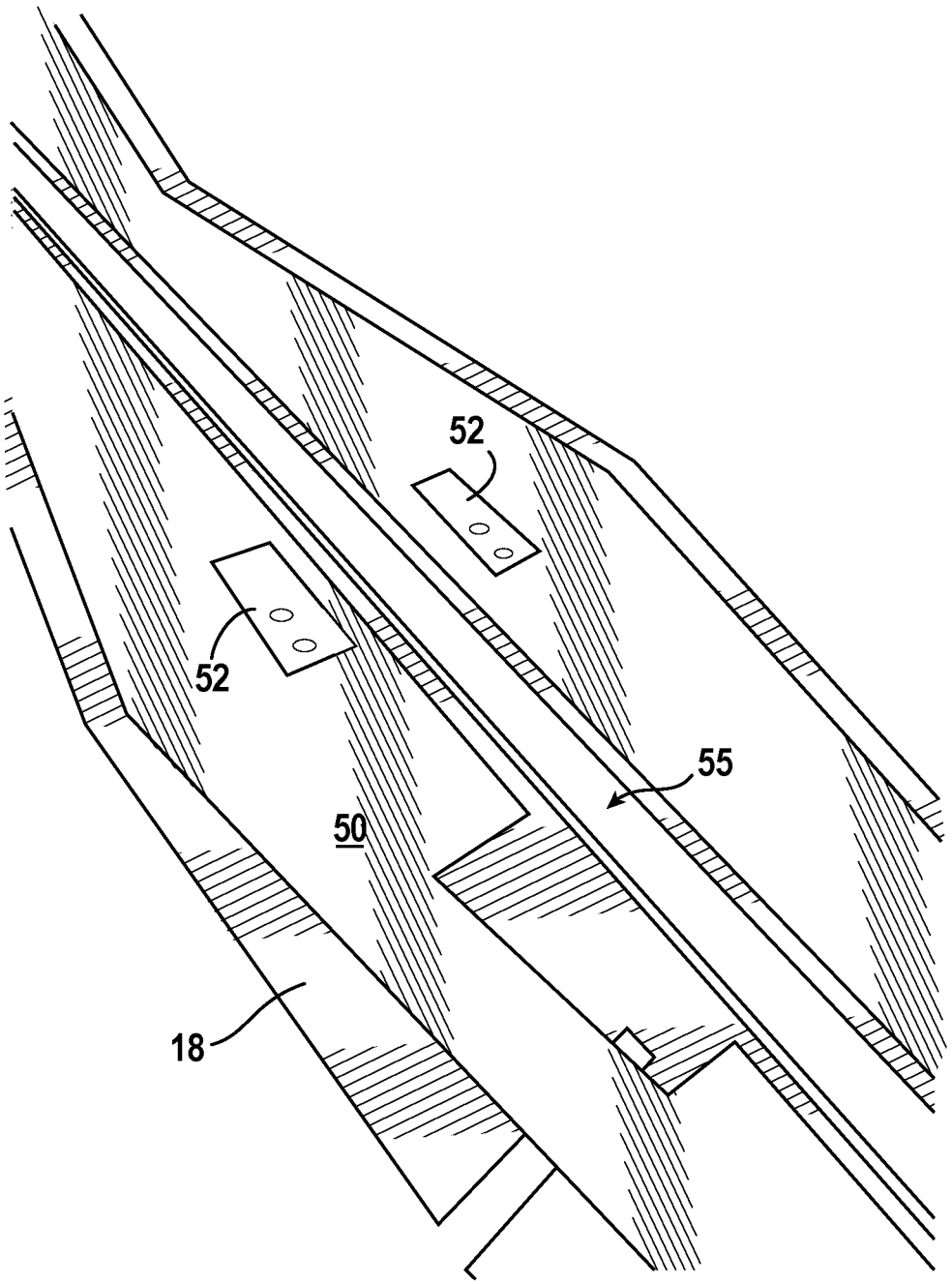
FIG. 8 illustrates a perspective view of a connection element overlaid on a spine.

FIG. 8 is an illustration of a spine 18 associated with a lighting element 55. As depicted in FIG. 8, the lighting element 55 is an LED light strip. In some implementations, the lighting element includes ports for any number or type of light, including, for example, a halogen bulb/lamp, an incandescent bulb, fluorescent lights, etc. A connection plate 50 is depicted as coupled to the spine 18 and having a similar shape/contour to the spine 18. The connection plate includes a plurality of guides and connection apertures 52. The guides can include, for example, a location for accepting a fastener associated with the shade, such as a mortise-tenon pairing or a grooved recess that mates with a bolt. The connection apertures 52 are illustrated as rectangular apertures and are sized and shaped to accommodate a clip or other similar connection mechanism. A cut-out in the plate 50 and a cut-out in the spine 18 can also accommodate electrical wiring to power the lighting element 50.

In some implementations, the plate can slide under the flanges (e.g., to the inside surface thereof, adjacent the cavity of the shade). In other implementations, the plate can be attached on top or on the outside of the flanges. In at least one implementation, the attached plate and shade can comprise a shade assembly.

In an implementation, one or more shade assemblies can be attached to the plate and/or spine, forming a mounted shade assembly. For instance, the shade assembly can be clipped onto the spine by sliding the plate into place (e.g., onto the clips of the spine). The clips and clip-openings can be configured for a secure and/or tight attachment (e.g., to reduce wiggling and/or unintentional disassociation). Other attachment mechanisms, including without limitation adhesives and other forms of fasteners, are also contemplated herein. For double shade light fixtures, such as light assembly 10 illustrated in FIG. 1, a second shade assembly can be mounted to the opposing side of the spine in a similar manner.

In an implementation, one or more end pieces can be attached to the mounted shade assembly. For instance, the end piece(s) can be attached to the end edge of the spine, such as with fasteners (e.g., screws). In alternative implementations, the end piece(s) can be attached with an adhesive and/or to the shade, plate, or shade assembly thereof. The end piece(s) can additionally, or alternatively, be attached to the spine by a press-fit connection or an interference fit. In at least one implementation, the end piece(s) can be attached prior to mounting the shade to the plate and/or shade assembly to the spine.

As alluded to farther above, shades of the present disclosure can include polymeric panels having fold lines that, when folded, create facets and patterns that at least partially define a three dimensional shade or a surface thereof, such as, for example, shade 12*b* of FIG. 2. It should be appreciated, however, that shades having different shapes or contours than those previously described are possible and envisioned within the scope of this disclosure.

Figure 9:
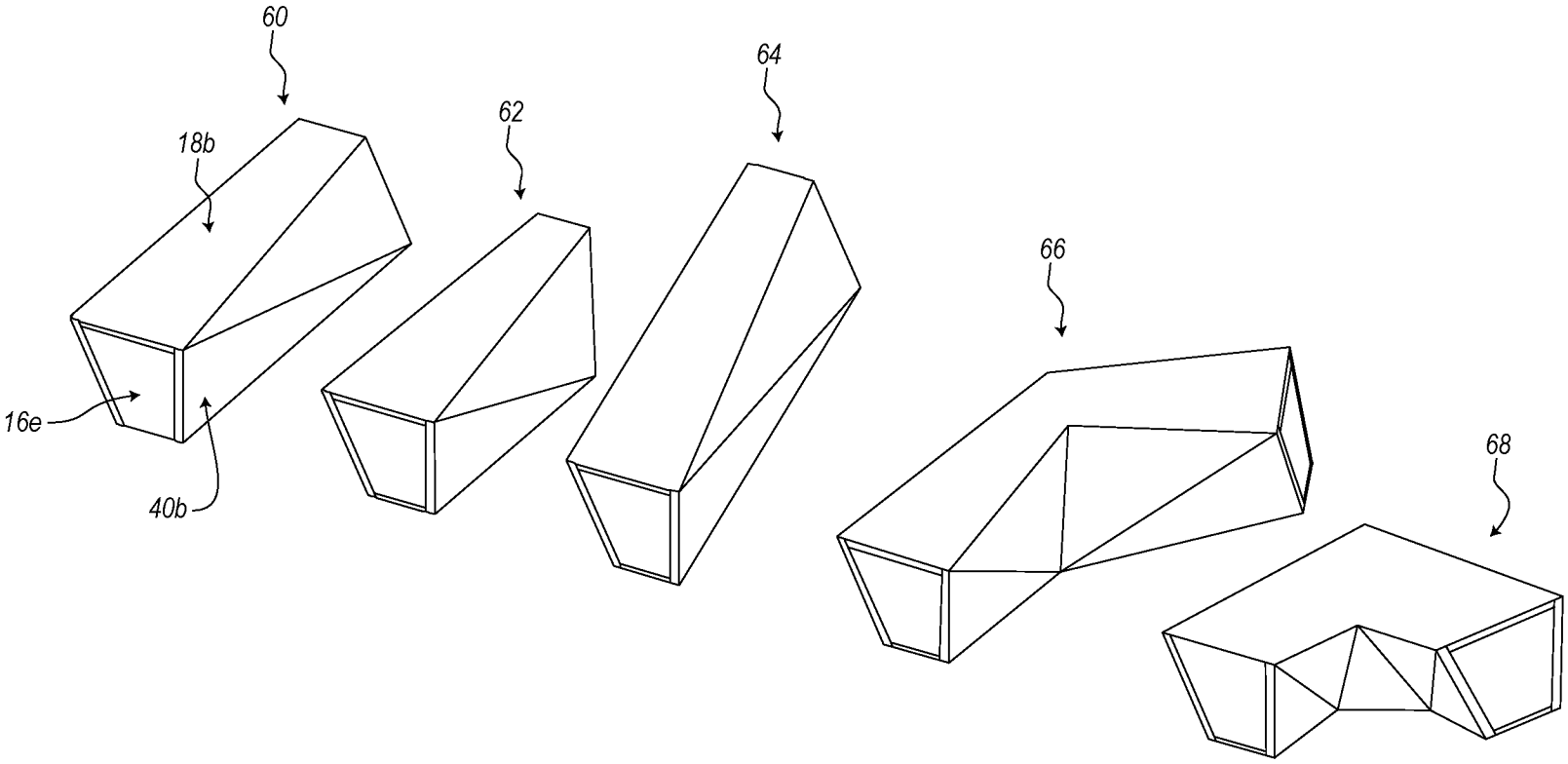
FIG. 9 illustrates exemplary modular light fixture elements for assembling a light fixture assembly.

Illustratively, FIG. 9 provides five exemplary shade assemblies 60, 62, 64, 66, 68 that include a polymeric panel having one or more fold lines that, when folded, create facets and/or patterns and which can be folded to at least partially define a different three dimensional shade or surface thereof. As illustrated, exemplary shade assembly 60 includes a body defined by a polymeric panel 40*b*. The polymeric panel 40*b* defines three sides of the exemplary shade assembly 60 in a U-shaped configuration, with a top side being closed by a spine and/or mounting element 18*e*, similar to the spine 18 and/or mounting element 18*b* described above. Shade assembly 60 additionally includes an end piece 16*e*, which in some implementations is analogous to one or more of end pieces 16*a*, 16*b*, 16*c*, and/or 16*e*.

It should be appreciated that while a polymeric panel 40*b* and a spine and/or mounting element 18*e* are only specifically illustrated with respect to shade assembly 60 in FIG. 9, the other shade assemblies 62, 64, 66, 68 illustrated in FIG. 9 include analogous polymeric panels and/or spine/mounting elements, the polymeric panels including a different number and/or angle of folding between facets of the various shade assemblies, as illustrated.

In some implementations, the end piece 16*e* of shade assembly 60 is not a separate panel or facet to be joined or otherwise associated with the shade assembly to close one end thereof. Rather, the end piece acts as a connecting element or connecting surface for joining a second shade assembly to the first shade assembly to create a larger shade assembly. In some implementations, the end piece of the first shade assembly connects to a corresponding end piece of a second shade assembly, thereby creating a new shade assembly that comprises the first and second shades. In this manner, or in a similar manner, exemplary shade assemblies 60, 62, 64, 66, 68 can be joined to create larger, differently shaped or contoured shade assemblies.

Figure 10:
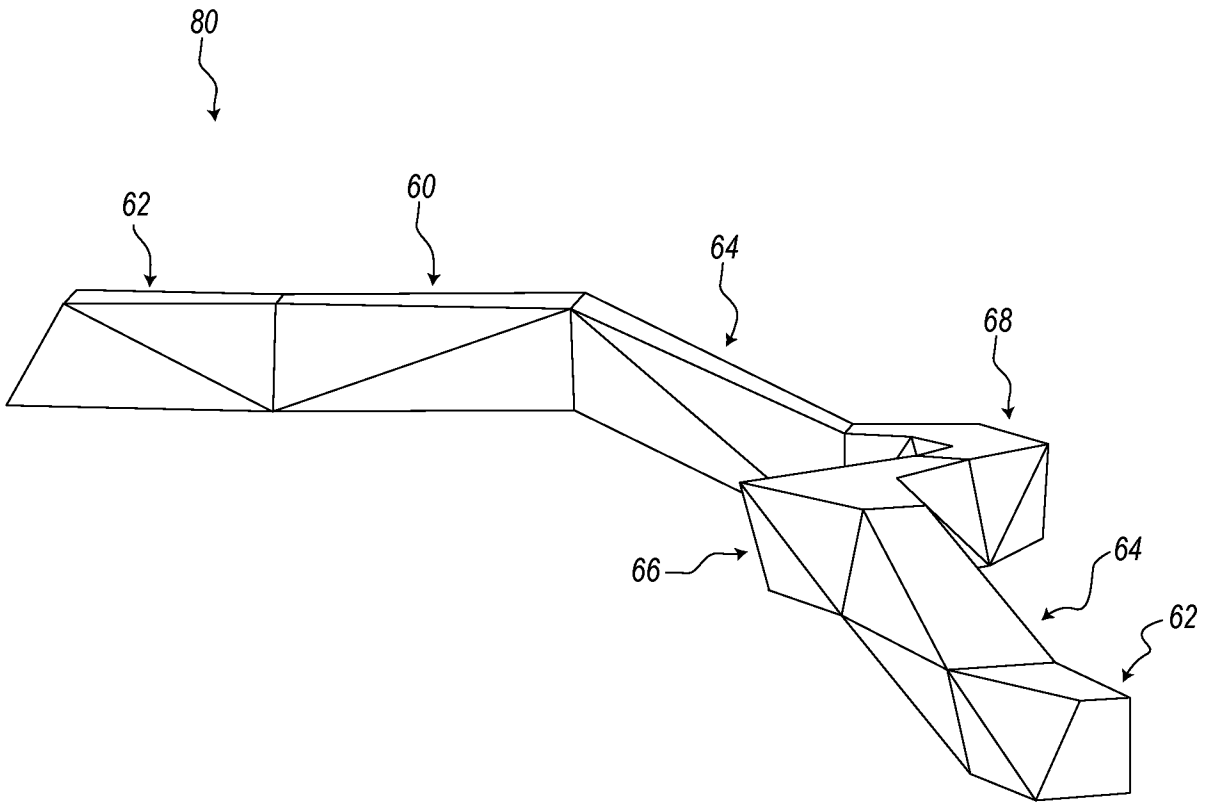
FIG. 10 illustrates an embodiment of a light fixture assembly constructed from a set of modular light fixture elements.

In some implementations, a subset of the exemplary shade assemblies are used to form a larger shade assembly and can be combined in an organized or random manner. For example, FIG. 10 illustrates a shade assembly 80 that comprises a seemingly random connection of exemplary shade assemblies from FIG. 9. As illustrated, shade assembly 80 is defined by shade assembly 62 at a first end, which is connected in series to shade assemblies 60, 64, 68, 66, 64, and 62, with shade assembly 62 comprising a second end of shade assembly 80. The resulting shape of shade 80 also appears random, which in some implementations, provides the sought after aesthetic appearance.

Figure 11:
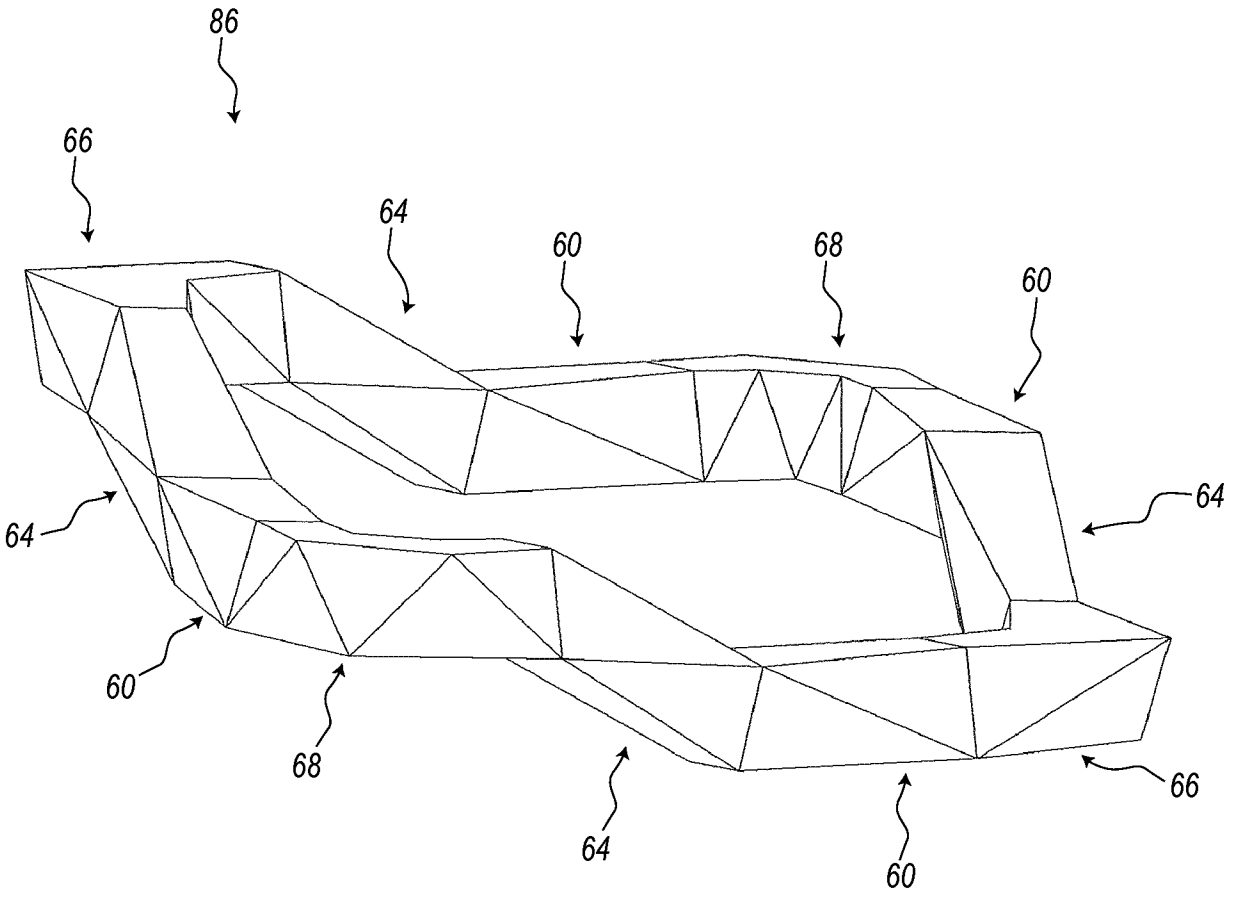
FIG. 11 illustrates another embodiment of a light fixture assembly constructed from a set of modular light fixture elements.

As an additional example, FIG. 11 illustrates a shade assembly 86 that comprises a repeated series of shades to form a continuous, elevation-changing loop. Illustratively, shade assembly 86 includes a twice repeated series defined by shade assembly 66 connected to shade assembly 64, which is connected to shade assembly 68, which is connected to shade assembly 60, which is connected to shade assembly 68, which is connected to shade assembly 60, which is connected to shade assembly 64. The terminal shade assembly 64 in the first series connects to the primary shade assembly 66 of the second, repeated series, and the ultimate shade assembly 64 connects to the primary shade assembly 66 of the first series, thereby forming a loop. Although illustrated as a twice repeated series, in some embodiments, the series repeats for a plurality of iterations. In some implementations, the repeated pattern or series of connected shades does not form a continuous loop; instead, it forms a light fixture assembly having ends that are not connected. In some embodiments, the pattern is palindromic (e.g., light fixture assembly 70 of FIG. 12A, being defined by the serial combination of shades 62-60-64-64-60-62). In some embodiments, the pattern is a compilation or series of connected patterns.

Figure 12A:
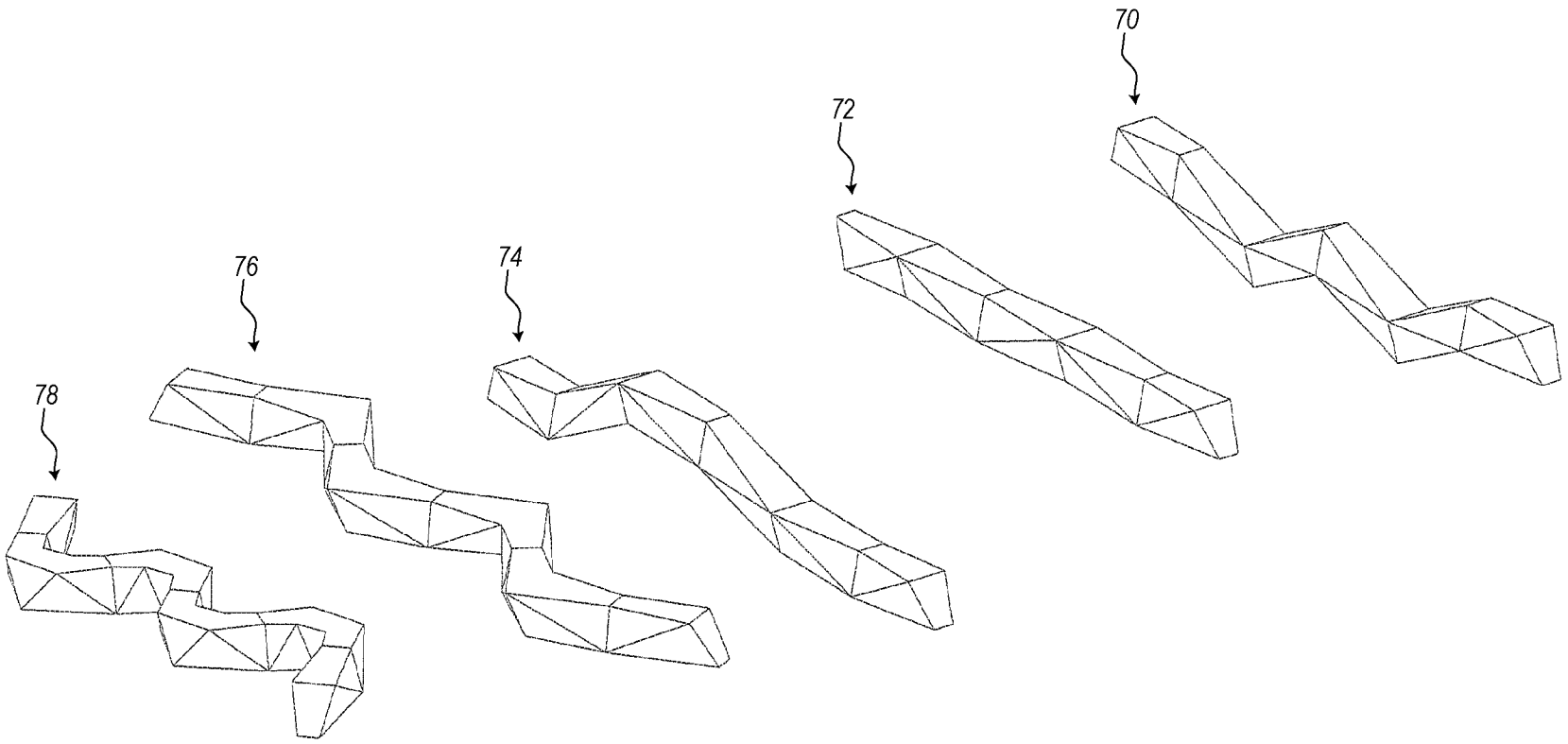
FIG. 12A illustrates exemplary light fixture assemblies in various configurations constructed using modular light fixture elements.
Figure 12B:
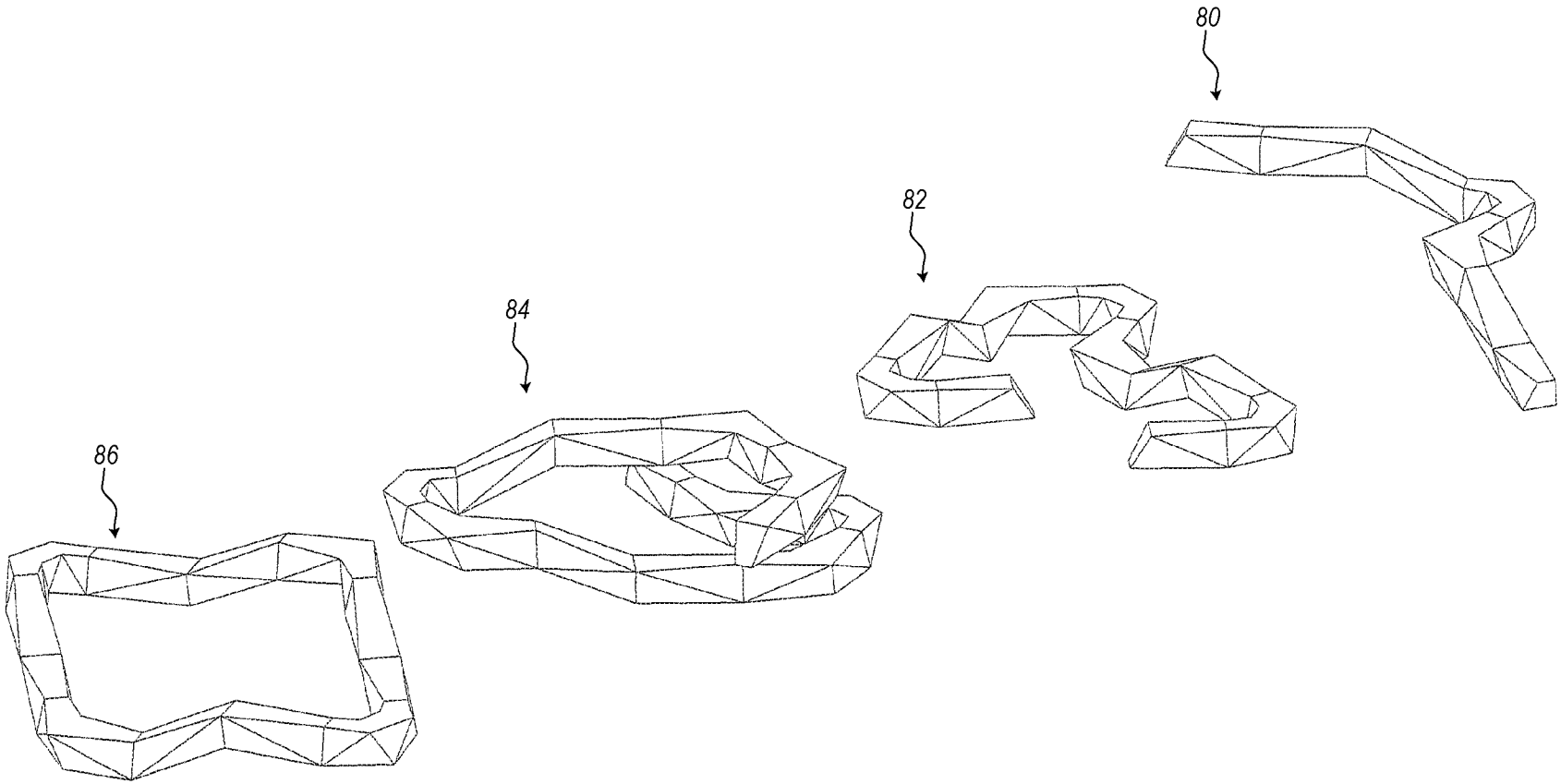
FIG. 12B illustrates additional exemplary light fixture assemblies in various configurations constructed using modular light fixture elements.

FIGS. 12A and 12B illustrate exemplary shade assemblies 70, 72, 74, 76, 78, 80, 82, 84, 86 that can be made by combining two or more of the different exemplary shade assemblies 60, 62, 64, 66, 68 shown in FIG. 9. As indicated by the reference numbers and as is evident by the drawings, shade assemblies 80 and 86 of FIGS. 10 and 11, respectively, are also depicted in FIG. 12B.

It should be appreciated that the shade assemblies depicted in FIGS. 12A and 12B are intended to be exemplary in nature and not limiting on the scope of the disclosure. Accordingly, other shade assemblies are included within the scope of this disclosure. For example, shade assemblies can be made by connecting more (e.g., a greater number) or less (e.g., a smaller number) shade assemblies than those depicted in FIGS. 12A and 12B. Additionally, or alternatively, other shade assemblies can be made by connecting two or more of the exemplary shade assemblies shown in FIG. 9 in a different ordered combination than those disclosed by FIGS. 12A and 12B.

In some implementations, a lighting element is disposed through an individual shade assembly (e.g., any of shade assemblies 70, 72, 74, 76, 78, 80, 82, 84, 86 of FIGS. 12A and 12B) to form a light fixture assembly. Alternatively, a plurality of lighting elements can be separately disposed within one or more shade assemblies to form a light fixture assembly.

It should also be appreciated that in some embodiments, there are additional or different exemplary shades that can be used to form larger shade assemblies. For example, a set of shade assemblies similar to those depicted in FIG. 9 may be used, but instead of the shade assemblies having a quadrilateral cross section, the cross section of each shade assembly is triangular, pentagonal, hexagonal, heptagonal, octagonal, nonagonal, decagonal, or other non-quadrilateral polygonal cross-section. In some implementations, the cross sections of each shade assembly is different than one other shade assembly or has a first end that is a first cross sectional shape and a second end that is a different cross sectional shape than the first end. For example, a shade assembly can include a first end having a trapezoidal cross section (similar to that shown in FIG. 9) and a second end having a triangular cross section (similar to that shown in FIG. 5). Accordingly, a first end of the foregoing shade assembly could be used to join a shade assembly having a trapezoid-shaped end with a shade assembly having a triangle-shaped end. For example, such a joining shade assembly could be used to associate one or more shades shown in FIGS. 1-6 with a shade shown in FIG. 9.

Additional description and disclosure of various implementations, features, components, and configurations is provided in U.S. Provisional Application No. 62/335,451, entitled Pivot Design and Manufacturing Methods, the entirety of which is incorporated herein by reference.

As used herein, the term "systems" also contemplates devices, apparatus, compositions, assemblies, kits, and so forth. Similarly, the term "method" also contemplates processes, procedures, steps, and so forth. Moreover, the term "products" also contemplates devices, apparatus, compositions, assemblies, kits, and so forth.

As used throughout this application the words "can" and "may" are used in a permissive sense (i.e., meaning having the potential to), rather than the mandatory sense (i.e., meaning must). Additionally, the terms "including," "having," "involving," "containing," "characterized by," as well as variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

It will be noted that, as used in this specification and the appended claims, the singular forms "a," "an" and "the" include plural referents unless the context clearly dictates otherwise. Thus, for example, reference to a "seam" includes one, two, or more seams. Similarly, reference to a plurality of referents should be interpreted as comprising a single referent and/or a plurality of referents unless the content and/or context clearly dictate otherwise. Thus, reference to "seams" does not necessarily require a plurality of such seams. Instead, it will be appreciated that independent of conjugation; one or more seams are contemplated herein.

As used herein, directional, positional, and/or orientational terms, such as "top," "bottom," "left," "right," "up," "down," "upper," "lower," "inner," "outer," "internal," "external," "interior," "exterior," "proximal," "distal" and so forth can be used arbitrarily and/or solely to indicate relative directions, positions, and/or orientations and may not be otherwise intended to limit the scope of the disclosure, including the specification, drawings, and/or claims.

Various aspects of the present disclosure can be illustrated by describing components that are bound, coupled, attached, connected, and/or joined together. As used herein, the terms "bound," "coupled", "attached", "connected," and/or "joined" are used to indicate either a direct association between two components or, where appropriate, an indirect association with one another through intervening or intermediate components. In contrast, when a component is referred to as being "directly bound," "directly coupled", "directly attached", "directly connected," and/or "directly joined" to another component, no intervening elements are present or contemplated.

To facilitate understanding, like references (i.e., like naming of components and/or elements) have been used, where possible, to designate like elements common to the figures. Specifically, in the exemplary implementations illustrated in the figures, like structures, or structures with like functions, will be provided with similar reference designations, where possible. Specific language will be used herein to describe the exemplary implementations. Nevertheless it will be understood that no limitation of the scope of the disclosure is thereby intended. Rather, it is to be understood that the language used to describe the exemplary implementations is illustrative only and is not to be construed as limiting the scope of the disclosure (unless such language is expressly described herein as essential).

Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and/or sub-elements of a parent element may each include separate letters appended to the element number. In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular implementation(s) in which they are illustrated. In other words, reference to a specific feature in relation to one implementation and/or embodiment should not be construed as being limited to applications only within said implementation.

The headings used herein are for organizational purposes only and are not meant to be used to limit the scope of the description or the claims.

Various alterations and/or modifications of the inventive features illustrated herein, and additional applications of the principles illustrated herein, which would occur to one skilled in the relevant art and having possession of this disclosure, can be made to the illustrated implementations without departing from the spirit and scope of the invention as defined by the claims, and are to be considered within the scope of this disclosure. Thus, while various aspects and implementations have been disclosed herein, other aspects and implementations are contemplated. While a number of methods and components similar or equivalent to those described herein can be used to practice implementations of the present disclosure, only certain components and methods are described herein.

It will also be appreciated that systems, processes, and/or products according to certain implementations of the present disclosure may include, incorporate, or otherwise comprise properties features (e.g., components, members, elements, parts, and/or portions) described in other implementations disclosed and/or described herein. Accordingly, the various features of certain implementations can be compatible with, combined with, included in, and/or incorporated into other implementations of the present disclosure. Thus, disclosure of certain features relative to a specific implementation of the present disclosure should not be construed as limiting application or inclusion of said features to the specific implementation. Rather, it will be appreciated that other implementations can also include said features without necessarily departing from the scope of the present disclosure. Moreover, unless a feature is described as requiring another feature in combination therewith, any feature herein may be combined with any other feature of a same or different implementation disclosed herein. Furthermore, various well-known aspects of illustrative systems, processes, products, and the like are not described herein in particular detail in order to avoid obscuring aspects of the example implementations. Such aspects are, however, also contemplated herein.

The present disclosure may be embodied in other specific forms without departing from its spirit or essential characteristics. The described implementations are to be considered in all respects only as illustrative and not restrictive. The scope of the invention is, therefore, indicated by the appended claims rather than by the foregoing description. Each of the appended claims, as well as the recited elements thereof, is intended to be combinable with any other claim(s) and/or element(s) in any suitable combination or dependency without regard to the dependency in which said claims are presented. While certain implementations and details have been included herein and in the attached disclosure for purposes of illustrating implementations of the present disclosure, it will be apparent to those skilled in the art that various changes in the methods and apparatus disclosed herein may be made without departing from the scope of the invention, which is defined in the appended claims. All changes which come within the meaning and range of equivalency of the claims are to be embraced within their scope.

The invention claimed is:

1. A light fixture assembly, comprising:
- a spine;
- a lighting element associated with the spine; and
- a first light shade associated with the spine and at least partially covering the lighting element, the first light shade comprising:
  - a first surface formed by a plurality of adjacent, alternating peak and trough folds that define intervening facets;
  - a second surface disposed opposite the top surface;
  - an edge surface transverse to and connecting the first surface and the second surface; and
  - one or more triangular end pieces coupled to one or more of a first open end of the first light shade or an opposing second open end of the first light shade.

2. The light fixture assembly as in claim 1, wherein the intervening facets are each in the shape of a triangle with adjacent triangular facets sharing an edge, the edge being one of a peak fold or a trough fold.

3. The light fixture assembly as in claim 2, wherein the trough folds of the plurality of adjacent, alternating peak and trough folds disposed on a topthe first surface alternate between a positive plunge trough fold and a negative plunge trough fold.

4. The light fixture assembly as in claim 3, wherein:

the first surface, the second surface, and the edge surface comprise a unitary polymeric sheet; and the second surface is a mirror image of the first surface.

5. The light fixture assembly as in claim 4, further comprising a second light shade associated with the spine, the second light shade being opposite the first light shade and being a mirror image of the first light shade.

6. The light fixture assembly as in claim 5, wherein the intervening facets of the edge surface comprise isosceles triangles joined at a base of each triangle, the joined base forming a trough fold.

7. The light fixture assembly as in claim 1, further comprising one or more mounting extensions connected to the spine, the one or more mounting extensions being additionally coupled to a suspension member configured to suspend the light fixture assembly.

8. The light fixture assembly as in claim 1, further comprising:

a second light shade, the second light shade being opposite the first light shade and being a mirror image of the first light shade;

one or more additional triangular end pieces coupled to one or more of a first open end of the second light shade or an opposing second open end of the second light shade; and one or more mounting extensions associated with the spine.

9. A method of manufacturing a light fixture, comprising:

assembling a first light shade, wherein assembling a first light shade comprises:

forming a plurality of fold lines on a unitary polymeric panel; and folding the unitary polymeric panel along the plurality of fold lines so as to create:

a first surface;

a second surface disposed opposite the first surface;

an edge surface transverse to and connecting the first surface and the second surface;

a plurality of adjacent, alternating peaks and valleys that define intervening polygonal facets;

one or more triangular end pieces coupled to one or more of a first open end of the first light shade or an opposing second open end of the first light shade;

one or more flanges disposed at opposing ends of the unitary polymeric panel; and coupling the one or more flanges of the first light shade to a spine, the spine being associated with a lighting element, wherein the first light shade is coupled to the spine such that the first light shade at least partially covers the lighting element.

10. The method of claim 9, further comprising:

affixing one or more mounting extensions to the spine; and coupling the mounting extensions to a suspension member configured to suspend the light fixture assembly.

11. The method of claim 9, further comprising assembling a second light shade by repeating the forming and folding steps of claim 9, and coupling the one or more flanges of the second light shade to an opposite side of the spine as the first light shade.

12. The method as in claim 11, further comprising affixing one or more mounting extensions to the spine.

13. The method as in claim 12, further comprising coupling the mounting extensions to a suspension member configured to suspend the light fixture assembly.

14. The method of claim 9, further comprising mounting the light fixture on one or more of a surface or a stand.

15. The method of claim 9, wherein the unitary polymeric panel comprises polyethylene terephthalate (PET) or polyethylene terephthalate with glycol-modification (PETG).

16. The method of claim 9, wherein the lighting element is an LED light strip.

17. The method of claim 9, wherein forming a plurality of fold lines on a unitary polymeric panel comprises scoring, perforating, or indenting.

18. The light fixture assembly as in claim 1, wherein the lighting element is disposed in a hollow interior cavity.

19. The light fixture assembly as in claim 1, wherein the lighting element is an LED light strip.

20. The light fixture assembly as in claim 4, wherein the unitary polymeric sheet comprises polyethylene terephthalate (PET) or polyethylene terephthalate with glycol-modification (PETG).

* * * * *